United States Patent [19]

Mitchell

[11] Patent Number: 4,698,149

[45] Date of Patent: Oct. 6, 1987

[54] ENHANCED RECOVERY OF HYDROCARBONACEOUS FLUIDS OIL SHALE

[75] Inventor: Thomas O. Mitchell, Trenton, N.J.

[73] Assignee: Mobil Oil Corporation, New York, N.Y.

[21] Appl. No.: 549,120

[22] Filed: Nov. 7, 1983

[51] Int. Cl.[4] ..... C10G 1/00

[52] U.S. Cl. ..... 208/428; 208/429; 208/415

[58] Field of Search ..... 208/11 LE, 415, 428, 208/429

[56] References Cited

U.S. PATENT DOCUMENTS

| | | | |
|---|---|---|---|
| 1,778,515 | 10/1930 | Hampton | 208/11 R |
| 2,601,257 | 11/1949 | Buchan | 208/11 LE |
| 2,847,306 | 8/1958 | Stewart et al. | 208/11 LE |
| 3,697,412 | 10/1982 | Brumhall | 208/11 LE |
| 4,108,760 | 8/1978 | Williams et al. | 208/11 LE |
| 4,238,315 | 12/1980 | Patzer, II | 208/11 LE |
| 4,325,803 | 4/1982 | Green et al. | 208/11 LE |
| 4,390,411 | 6/1983 | Scinta et al. | 208/11 LE |
| 4,438,816 | 3/1984 | Urban et al. | 208/11 LE |
| 4,449,586 | 5/1984 | Urban et al. | 208/11 LE |
| 4,461,696 | 7/1984 | Bock et al. | 208/11 LE |
| 4,500,414 | 2/1985 | Audeh | 208/11 LE |

FOREIGN PATENT DOCUMENTS

| | | | |
|---|---|---|---|
| 1469800 | 7/1946 | Canada | 208/11 LE |
| 1528918 | 8/1956 | Canada | 208/11 LE |
| 1323773 | 1/1930 | United Kingdom | 208/11 LE |
| 1495722 | 12/1977 | United Kingdom | 208/11 LE |

*Primary Examiner*—Andrew H. Metz
*Assistant Examiner*—Heleme Myers
*Attorney, Agent, or Firm*—Alexander J. McKillop; Michael G. Gilman; Charles A. Malone

[57] ABSTRACT

The present invention relates to a novel method for improving the recovery of hydrocarbon fluids from oil shale. The method comprises treating a mixture of oil shale and hydrocarbon fluid at a temperature below the retorting temperature of the shale and for a period of time sufficient to recover product hydrocarbon fluids in amount equivalent to at least 100 percent Fischer Assay.

21 Claims, No Drawings

ENHANCED RECOVERY OF HYDROCARBONACEOUS FLUIDS OIL SHALE

FIELD OF THE INVENTION

The present invention relates to an improved process for the recovery of hydrocarbonaceous fluids from oil shale. More specifically, the present invention relates to a process which substantially increases the yield of hydrocarbonaceous fluids from oil shale.

BACKGROUND OF THE INVENTION

The potential reserves of liquid hydrocarbons contained in subterranean carbonaceous deposits are known to be very substantial and form a large portion of the known energy reserves in the world. In fact, the potential reserves of liquid hydrocarbons to be derived from oil shale greatly exceed the known reserves of liquid hydrocarbons to be derived from petroleum. As a result of the increasing demand for light hydrocarbon fractions, there is much current interest in economical methods for improving the recovery of hydrocarbon liquids from oil shale on commercial scales.

It has long been known that oil may be extracted by retorting from various extensive deposits of porous minerals known by their generic term "oil shale", which are permeated by a complex organic material called "kerogen". Upon application of retorting, the kerogen is converted to a complex mixture of hydrocarbons and hydrocarbon derivatives which may be recovered from a retort as a liquid shale oil product. While retorting may be the most common method utilized to recover hydrocarbon fluids from oil shale, it has several disadvantages one of which is that shale oil cracks to gas readily at conventional retorting conditions. The cracking of shale oil to gas is disadvantageous in that it substantially reduces the total oil recovered from the oil shale.

Furthermore, retorting is not very successful on all types of oil shales. For example, Eastern shales are known to contain an equal proportion of organic carbon as the Western shales. However, upon retorting, only about 30 percent of this carbon is converted to oil. This conversion is less than half of the conversion achieved by retorting Western shale. To clarify this fact, consider two oil shale samples containing 13.6 percent organic carbon. Retorting the Western shale would reduce this carbon to about four percent. On the other hand, retorting Eastern shale would reduce this carbon to only about 10 percent. Thus, any technique that may be used to improve this conversion as measured by enhancement in oil yield will be highly advantageous particularly when applied to Eastern shale.

Accordingly, the present invention provides a process to enhance the yield of hydrocarbon fluids from oil shale by treating the shale under milder conditions than retorting conditions.

U.S. Pat. No. 4,238,315 to Patzer, II, relates to a process for recovering oil from oil shale containing kerogen which comprises bringing a mixture of oil shale and solvent to a temperature in the range of about 385° to about 400° C. in a time period of less than about 10 minutes, maintaining the mixture at a temperature in the range of about 385° to about 440° C. and a pressure in the range of about 250 to about 2,000 psig for a period of about 20 minutes to about 2 hours and thereafter recovering the resulting oil. These conditions are much more severe than those utilized in the present invention.

Furthermore, Patzer states that a weight ratio of solvent to shale of at least 1.25:1, preferably at least 1.5:1 must be employed. This is a very high ratio of solvent particularly when one considers solvent cost, increased heating costs, capacity requirements of equipment, and storage facilities in plants.

U.S. Pat. No. 4,325,803 to Green et al relates to a method for the separation and recovery of organic material from rock which includes forming a slurry comprising rock containing organic material and a hydrogen transfer agent that is liquid at standard conditions, subjecting the slurry to elevated temperatures (300° to 650° C.) and elevated pressures (10 atmospheres to 200 atmospheres), and subjecting the product to adiabatic flash vaporization. The required conditions of the Green et al process are again much more severe than those utilized in the present invention. The Green et al process not only requires that the amount of hydrocarbon liquid added to the shale be at least 25 weight percent of the shale, but also requires that the hydrocarbon liquid contain at least 25% hydrogen donating compounds. Furthermore, the Green et al process is limited to utilizing hydrogen transfer liquids which have a low boiling point not greater than 325° C. (617° F.). Thus, not only is the amount of solvent required excessive but the solvent is limited to lighter cuts with the additional requirement that the lighter cuts contain at least 25% hydrogen donating compounds.

Hampton in U.S. Pat. No. 1,778,515 states that it is old to subject a bituminiferous material, such as oil shale, to the digestive action of an oil bath to recover oil from oil shale. It is further stated that increased yields of oil can be obtained by mixing oil shale of 1½ inch mesh with a heavy oil, which may be preheated, heating the resulting mixture gradually to a temperature of 300° to 400° F. (144° to 204° C.), grinding the shale in the heated mixture until 60 percent or more thereof will pass 200 mesh, and then heating the ground mixture, most desirable suddenly, to a materially high temperature in the range of about 600° to about 700° F. (316° to about 371° C.). Hampton considers the possibility of feeding dry pulverized shale, without any accompanying oil, in controllable amounts into a hot digestion bath, but advises against the same because of technical difficulties.

SUMMARY OF THE INVENTION

The present invention relates to a process for improving the recovery of oil from oil shale containing kerogen by thermally treating the oil shale in the presence of a hydrocarbon fluid. A mixture of oil shale and a hydrocarbon fluid is brought to a temperature below the retorting temperature. It is preferred that the hydrocarbon fluids consist essentially of shale oil or fractions thereof, petroleum or fractions thereof, or any mixture thereof. The mixture is maintained at a temperature in the range of about 300° C. to about 450° C. and substantially autogeneous pressure for a period of about 0.5 to about 30 minutes or more. When the added hydrocarbon fluid is a hydrogen donor, the amount of fluid added should not exceed 25 weight (wt.) percent of the shale to be treated. When the hydrocarbon fluid is not a good hydrogen donor, the amount of fluid added need not exceed 120 wt. percent of the shale to be treated. Furthermore, high boiling point hydrocarbon fluids, such as those having a boiling range which is greater than 625° F. (330° C.), are suitable for application in the present invention. Subsequently the resulting oil is recovered and separated from the host material.

DESCRIPTION OF THE SPECIFIC EMBODIMENTS

The present invention relates to a process for improving the recovery of oil from oil shale containing kerogen by thermally treating the oil shale under milder conditions than previously known in the presence of added normally liquid hydrocarbons. For comparison purposes, the reaction severity is defined by the equation:

Reaction Severity = Temperature (°C.) × Pressure (atm) × Duration (minutes)

In accordance with the present invention, the oil shale is crushed to a desirable size. The crushed oil shale is mixed with a hydrocarbon fluid. The hydrocarbon fluid is preferably a petroleum stream, recycled shale oil, or any mixture thereof. The ratio of added liquid hydrocarbon to shale depends on the type of shale being processed and on the liquid hydrocarbon utilized. This ratio should be determined on a case by case basis to result in optimum recovery of additional hydrocarbon fluids from the shale being treated. It was determined that a suitable added liquid hydrocarbon to oil shale ratio from about 0.01:1 to about 1:1 by weight is suitable and preferred. When the added liquid hydrocarbon is a good hydrogen donor, the amount of added liquid hydrocarbon need not exceed 25% by weight of the oil shale to be treated. Normally, higher fractions of petroleum or shale oil, i.e. 625° F.+, are less desirable than lower fractions. These higher fractions, having a distillation temperature not less than 625° F., are suitable for application in the present invention.

The temperature should be below the retorting temperature of the shale and accordingly should not be greater than about 450° C. with a preferred temperature between 300° C. and 425° C. It is preferred that the treatment be carried out without added pressure, i.e., under initial ambient pressure. However it is clear that increases in pressure may be tolerated. The duration of the treatment should be such that the treatment sould result in the recovery of hydrocarbon fluids from the shale in amounts greater than 100% of Fischer Assay. The Fischer Assay method is well known in the art, and is utilized herein for comparison purposes. It is preferred that the treatment is carried out for a duration of from about 0.5 minutes to about 30 minutes.

To better illustrate the invention, the following experiments were performed. Eastern shale samples were utilized. The Eastern shale samples were obtained from an outcrop of the New Albany formation near Shepardsville, Bullitt County, Ky. A 16/28 mesh sample was used. This shale has a Fischer Assay of 17 gallons per ton and a Rapid Heat-up Assay of 18 gallons per ton indicating that it has not been air-oxidized. The Rapid Heat-Up Assay method is described in a concurrently filed application entitled "RAPID HEAT-UP ASSAY FOR OIL SHALES" by C. A. Audeh, which is hereby incorporated by reference. The analysis of the shale appears in the following Table I.

TABLE I

| COMPONENT | OIL SHALE ANALYSIS % | |
|---|---|---|
| C | 15.31 | |

TABLE I-continued

| COMPONENT | OIL SHALE ANALYSIS % | |
|---|---|---|
| H | 1.53 | |
| O | 0.30 | |
| N | 1.10 | |
| S | 5.86 | |
| Ash | 76.50 | |
| pyritic S | 5.16 | |
| Carbonate | 1.07 | included in ash |
| Moisture | 2.0 | |

TABLE II

| | ADDED OILS | | | |
|---|---|---|---|---|
| | 450–850° F. Paraho | Full Range Hydrogenated Paraho | CSO | Hydrogenated CSO |
| % C | 84.47 | 84.55 | 88.27 | 89.61 |
| H | 11.65 | 12.23 | 6.73 | 9.60 |
| N | 1.90 | 1.71 | 0.09 | 0.03 |
| O | 1.25 | 1.24 | 0.91 | 0.8 |
| S | 0.83 | 0.27 | 5.27 | 0.9 |
| Basic N | 1.24 | 1.18 | 0 | 0 |
| IBP° F. | 452 | 315 | 308 | 213 |
| 50% | 675 | 737 | 806 | 693 |
| FBP | 854 | 1120 | 915 | 827 |

The oils utilized are listed in Table II. The Paraho oils are cuts from a distillation procedure. The hydrogenated Paraho oil is the product of a shale oil dearsenation process wherein the oil was subjected to mild hydrotreatment with a conventional hydrotreating catalyst. Clarified slurry oil (CSO) is also utilized. A portion of the CSO was treated with conventional hydrotreating catalyst to produce the hydrogenated CSO.

Stainless steel reactors were utilized, shaken in a fluidized sand bath. Reactions were usually run in pairs. In each pair, one reactor was simply a tube, designated "bomb" with a Swagelok fitting at each end. The other reactor designated "side-arm", was similar but had a side-arm fitted with a thermocouple and a valved line leading to a pressure transducer. During a run, the entire bomb was under the sand but the side-arm portion of the side-arm reactor and the line leading to the the transducer were above and therefore cooler. Reactor volumes are about 60 mls. with the side-arm and lines volume being about 3 mls.

For a typical run, 30 grams of shale were weighed into each reactor. If a liquid was to be included, portions of the shale and liquid were added alternately with shale first and last. It was observed that the raw shale would not sorb the 3.0 grams of liquid usually used. The reactors were sealed, the side-arm reactor pressure tested with helium. The reactors were weighed and then mounted horizontally on a motor to shake them at approximately 500 vertical strokes per minute.

A fluidized sand bath was preheated to a temperature above that desired for the run. To start a run, the bath was raised around the reactors and shaking begun. Bath and reactor temperature and reactor pressure were recorded. To end a run the bath was lowered, the reactors were air cooled to 300° C. and then water cooled to room temperature. Heating and cooling each took typically approximately 2 minutes. Fluctuation at reaction temperature was typically less than ±5° C.

To assess the relative severity of runs, a reaction severity was calculated using the time-temperature -pressure equation described above.

After reaction the cooled reactors were weighed, opened, and reweighed; weight loss was gas. A gas sample was taken from the side-arm reactor during this step and subjected to mass spec analysis. The line to the pressure transducer was drained; it usually contained about 0.5 g liquid, mostly water. Work up for each reactor was as follows. Light products were vacuum distilled directly from the reactor to an atomospheric boiling point of 400° F. The reactor contents were washed into a Soxhlet thimble with heptane. If necessary tetrahydrofuren was also used in the transfer but stripped off before the extraction. The shale was then extracted with heptane overnight, the heptane stripped off and the liquid product and residue each dried in flowing helium (HE) is a vacuum oven at about 115° C. to constant weight. The residue was then Soxhlet extracted with pyridine and the soluble product recovered as above. The weight of pyridine-insolubles was taken as the difference between heptane-insolubles and pyridine-solubles. Apparent kerogen conversions were calculated from the residue elemental analysis and the parent shale elemental analysis, correcting for shale water content.

The validity of this work-up procedure was tested as follows using the same Bullitt County shale in all cases. Soxhlet extraction of raw shale gave no heptane solubles and 0.98 weight percent pyridine solubles. When 4.78 weight percent Paraho shale oil was put on the shale by suspension in THF and stripping off the THF, 96.7 percent of the oil was subsequently removed by heptane extraction, and the remainder (plus 0.36 weight percent (based on shale) pyridine solubles from the shale) was removed by pyridine. A similar oil on shale preparation was vacuum distilled at 393° C. to an atmospheric boiling point of 500° C.; 86.8 percent of the oil was recovered. Subsequent extraction with heptane yielded no oil; pyridine extraction then yielded a weight equivalent to the remaining added oil but no shale pyridine solubles. Extraction of spend shales from Fischer or RHU assays yielded no heptane solubles; there were no pyridine solubles in the spent RHU shale and 0.20 weight percent pyridine solubles in the spent Fischer assay shale. All these tests indicate that the extraction work-up reliably recovers the same oil as would be recovered in a retort. Recovered oils were indistinguishable from the original oil by Vapor Phase Chromatography with C, N, and S detectors. Nevertheless, it should be kept in mind that the oils in these shaker bomb experiments were not recovered in the usual way.

In the following tables, the following abbreviations are utilized with the product distribution being in grams:

SHALE:

EASTBC=Eastern (Bullitt County),

SPENTBC=Spent Bullitt County shale from RHU assay,

WESTGR=Western (Green River).

RTVD: Room temperature vacuum distillation (400° F. TBP),

G LINE: Recovered from gas line,

G/T: Gallons per ton,

H/P: Ratio of heptane soluble to heptane insoluble/-pyridine soluble,

KER CONV: Kerogen conversion,

B/SA: Ratio of G/T for bomb vs. side-arm.

OIL:

P850-=Paraho 450° F.-850° F. cut,

CSO=Clarified slurry oil,

H-CSOL=Hydrogenated clarified slurry oil,

HFRP=Hydrogenated full range Paraho oil,

DHP=9,10-dihydrophenathrene,

P850+=Paraho 850° F.+ oil.

Table III shows blanks run with oil and no shale and with oil and a shale that had already been retorted to 500° C. In the blank runs, 450°-850° F. Paraho oil was essentially stable at 405° C. for 10 min (Runs 19 and 20), producing only 1 weight percent gas, less than 1 weight percent pyridine insoluble residue, and no heptane-insoluble/pyridine-soluble liquid. The hydrogenated CSO was similarly stable at 405° C. However, at 500° C. in 10 min. (Runs 21 and 22) the 450°-850° F. Paraho oil produced up to 29 percent gas, several percent heptane insoluble liquids, and traces of pyridine insoluble residue. Thus, under conventional retorting conditions shale oil is unstable.

Note that under severe conditions the oil produced more by-products in the bomb than in the side-arm reactor. It is believed that this is because in the side-arm reactor some of the oil distills into the side-arm above the sand bath level and is at a lower temperature.

Runs 33 and 34 show that a spent shale produced no new oil whether or not another oil was added; it did produce traces of water. Comparison of runs 28 and 34 shows that at 405° C. for 10 min. the presence of spent shale resulted in about 6 percent conversion of hydrogenated CSO into heptane insoluble material.

TABLE III

| | BLANK RUNS | | | | | | | |
|---|---|---|---|---|---|---|---|---|
| RUN # | 19 | 20 | 21 | 22 | 27 | 28 | 33 | 34 |
| REACTOR | S-A | B | S-A | B | S-A | B | S-A | B |
| SHALE | | | | | | | SPENT | SPENT |
| INITIAL PRESSURE (atm) | 1.0 | 1.0 | 1.0 | 1.0 | 1.0 | 1.0 | 1.0 | 1.0 |
| MIN | 10.00 | 10.00 | 10.00 | 10.00 | 10.00 | 10.00 | 10.00 | 10.00 |
| °C. | 405.00 | 405.00 | 500.00 | 500.00 | 405.00 | 405.00 | 405.00 | 405.00 |
| RXN SEVER | 4,050 | 4,050 | 5,000 | 5,000 | 4,050 | 4,050 | 4,050 | 4,050 |
| GAS | 0.03 | 0.06 | 0.65 | 0.87 | 0.05 | 0.10 | | 0.07 |
| WATER | | | | | | | 0.05 | 0.07 |
| RTVD | | | | | | | 0.12 | |
| G LINE | | | 0.88 | | | | | |
| HEPTL SOL | 2.85 | 3.68 | 1.45 | 1.05 | 3.95 | 3.90 | | 2.67 |
| PYR SOL | | | 0.08 | 0.05 | | | 0.02 | 0.13 |
| RESIDUE | 0.02 | 0.02 | 0.13 | 0.65 | | | 29.81 | 30.06 |
| TOTAL | 2.90 | 3.76 | 3.19 | 2.62 | 4.00 | 4.00 | 30.00 | 33.00 |
| G/T | | | | | | | 0.20 | 0.20 |
| LOSS | 0.10 | 0.24 | 0.81 | 1.38 | | | | |
| H/P | | | | | | | | 20.50 |

TABLE III-continued

| | BLANK RUNS | | | | | | | |
|---|---|---|---|---|---|---|---|---|
| RUN # | 19 | 20 | 21 | 22 | 27 | 28 | 33 | 34 |
| KER CONV | | | | | | | 0.40 | 0.40 |
| B/SA | | | | | | | | |
| OIL | P850- | P850- | P850- | P850- | H-CS01 | H-CS01 | | H-CS01 |

In the following discussion, the term "product oil" will be used to indicate new oil produced from shale in a run and "added oil" will mean oil added to a reactor before the start of a run. Calculations of product oil yields and properties always include corrections, based on blank runs, for contributions of added oil.

Table IV shows the results of experiments wherein oil shale was treated under conditions of the present invention but without any added oil. The shale oil yield maximized at 17 gallons per ton, which is the corresponding Fischer Assay oil yield for the shale, at a reaction severity of 4050 (actual run conditions 1 atm initial pressure, 405° C., for 10 minutes). At shorter times and/or lower temperatures, or at higher temperatures and shorter or equal times, the product oil yield was lower.

estingly, at higher severities (higher temperatures) less product oil was obtained than in runs without added oil. In fact, at 500° C., 10 minutes, and 1 atmospheres initial pressure (runs 3 and 4), there was a negative product oil yield; that is, less total oil was recovered than was obtained in the corresponding blank with no shale. Coking and cracking reactions consumed a weight of oil equal to all the product oil, some of which was certainly formed, plus more of the added oil than was consumed in the corresponding blank.

As in the case of the blanks, the bomb and the side-arm reactor gave slightly different results. At low reaction severity, the bomb gave higher product oil yields, and at high severity, the bomb gave lower yields. At low severity, oil whether added or product, was stable and enhanced yields. At high severity oil decomposition

TABLE IV

| | RUNS WITH NO ADDED OIL | | | | | | | |
|---|---|---|---|---|---|---|---|---|
| RUN # | 1 | 2 | 5 | 6 | 7 | 8 | 17 | 18 |
| REACTOR | B | S-A | S-A | B | S-A | B | S-A | B |
| SHALE | EASTBC | EASTBC | EASTBC | EASTBC | EASTBC | EASTBC | EASTBC | EASTBC |
| MIN | 10.00 | 10.00 | 0.50 | 0.50 | 10.00 | 10.00 | 0.50 | 0.50 |
| INITIAL PRESSURE (atm) | 1.0 | 1.0 | 1.0 | 1.0 | 1.0 | 1.0 | 1.0 | 1.0 |
| °C. | 500.00 | 500.00 | 500.00 | 500.00 | 405.00 | 405.00 | 405.00 | 405.00 |
| RXN SEVER | 5000 | 5000 | 250 | 250 | 4050 | 4050 | 202.5 | 202.5 |
| GAS | 1.63 | 1.63 | 0.36 | 0.89 | 0.02 | 0.28 | 0.14 | 0.14 |
| WATER | 0.70 | | | 0.80 | 0.11 | 0.70 | 0.30 | 0.40 |
| RTVD | 0.30 | 0.37 | 0.38 | 0.27 | | 0.08 | 0.11 | 0.20 |
| G LINE | | | 0.35 | | | | | |
| HEPTL SOL | 0.80 | 0.28 | 0.89 | 0.68 | 0.95 | 1.47 | 0.20 | 0.19 |
| PYR SOL | 0.11 | 0.12 | | 0.27 | 0.59 | 0.37 | 0.53 | 0.74 |
| RESIDUE | 26.99 | 27.21 | 27.34 | 27.11 | 27.27 | 27.06 | 28.46 | 28.14 |
| TOTAL | 30.53 | 29.61 | 29.32 | 30.02 | 28.94 | 29.96 | 29.74 | 29.81 |
| G/T | 5.30 | 6.80 | 14.40 | 10.80 | 13.70 | 17.00 | 7.50 | 10.00 |
| LOSS | 0.53 | 0.39 | 0.68 | 0.02 | 1.06 | 0.04 | 0.26 | 0.19 |
| H/P | 2.45 | 2.33 | | 2.52 | 1.61 | 3.97 | 0.38 | 0.26 |
| KER CONV | 29.80 | 26.90 | 25.30 | 28.30 | 26.20 | 28.90 | 10.80 | 15.00 |
| B/SA | 0.78 | 0.78 | 0.75 | 0.75 | 1.24 | 1.24 | 1.33 | 1.33 |
| OIL | | | | | | | | |

Table V shows the results of experiments wherein 10 weight percent, based on total shale, of a 450°–850° F. Paraho shale oil was added. A product oil yield maximum was observed at the same reaction severity. However, more product oil was obtained at or below this severity than was obtained without the added oil. Inter- and loss became predominant. The bomb maximizes contact between oil and shale while the side-arm allows some oil to escape the heat. This bomb vs. side-arm effect was not seen as a function of kerogen conversion or product oil yield but correlated very well with reaction severity.

TABLE V

| | RUNS WITH ADDED 450–850° F. PARAHO OIL | | | | |
|---|---|---|---|---|---|
| RUN # | 3.00 | 4.00 | 9.00 | 10.00 | 11.00 |
| REACTOR | B | S-A | B | S-A | B |
| SHALE | EASTBC | EASTBC | EASTBC | EASTBC | EASTBC |
| MIN | 10.00 | 10.00 | 10.00 | 10.00 | 0.50 |
| INITIAL PRESSURE (atm) | 1.0 | 1.0 | 1.0 | 1.0 | 1.0 |
| °C. | 500.00 | 500.00 | 370.00 | 370.00 | 500.00 |
| RXN SEVER | 5000 | 5000 | 3700 | 3700 | 250 |
| GAS | 2.67 | 2.47 | 0.13 | 0.13 | 1.20 |
| WATER | 0.70 | 0.30 | 0.55 | 0.23 | 0.75 |
| RTVD | 0.50 | 0.30 | 0.05 | 0.04 | 0.35 |
| G LINE | | 0.70 | | | |
| HEPTL SOL | 0.94 | 0.97 | 2.86 | 2.45 | 2.57 |
| PYR SOL | 0.12 | 0.12 | 0.85 | 0.86 | 0.52 |
| RESIDUE | 27.43 | 27.07 | 28.89 | 29.03 | 26.80 |

TABLE V-continued

| RUNS WITH ADDED 450-850° F. PARAHO OIL | | | | | |
|---|---|---|---|---|---|
| TOTAL | 32.36 | 31.93 | 33.33 | 32.74 | 32.19 |
| G/T | 9.00 | 9.60 | 7.00 | 3.50 | 4.20 |
| LOSS | 0.64 | 1.07 | 0.33 | 0.26 | 0.81 |
| H/P | 7.58 | 8.08 | 3.36 | 2.85 | 4.94 |
| KER CONV | 22.60 | 28.80 | 5.30 | 3.50 | 32.30 |
| B/SA | 0.77 | 0.77 | 2.17 | 2.17 | 1.25 |
| OIL | P850- | P850- | P850- | P850- | P850- |
| RUN # | 12.00 | 13.00 | 14.00 | 15.00 | 16.00 |
| REACTOR | S-A | B | S-A | S-A | B |
| SHALE | EASTBC | EASTBC | EASTBC | EASTBC | EASTBC |
| MIN | 0.50 | 10.00 | 10.00 | 0.50 | 0.50 |
| INITIAL PRESSURE (atm) | 1.0 | 1.0 | 1.0 | 1.0 | 1.0 |
| °C. | 500.00 | 405.00 | 405.00 | 405.00 | 405.00 |
| RXN SEVER | 250 | 4050 | 4050 | 202.5 | 202.5 |
| GAS | 0.35 | 0.48 | 0.35 | 0.05 | 0.15 |
| WATER | 0.20 | 0.60 | 0.30 | | 0.65 |
| RTVD | 0.05 | 0.39 | 0.12 | 0.34 | 0.21 |
| G LINE | 0.52 | | 0.49 | 0.10 | |
| HEPTL SOL | 2.39 | 4.27 | 3.55 | 2.59 | 3.22 |
| PYR SOL | 0.39 | 0.91 | 0.52 | 0.61 | 1.40 |
| RESIDUE | 26.80 | 25.98 | 26.72 | 28.61 | 27.00 |
| TOTAL | 30.70 | 32.63 | 32.05 | 32.30 | 32.63 |
| G/T | 3.40 | 27.60 | 17.40 | 5.70 | 16.20 |
| LOSS | 2.30 | 0.37 | 0.95 | 0.70 | 0.37 |
| H/P | 6.15 | 4.69 | 6.83 | 4.25 | 2.30 |
| KER CONV | 32.30 | 42.00 | 33.30 | 8.90 | 29.70 |
| B/SA | 1.25 | 1.59 | 1.59 | 2.84 | 2.84 |
| OIL | P850- | P850- | P850- | P850- | P850- |

When better hydrogen donors were used as added oils, higher product oil yields were obtained as shown in Table VI. Hydrogenated Paraho oil, 850° F.+ Paraho oil and clarified slurry oil (CSO) were equal to the 450°-850° F. Paraho oil as was pyrene which is a hydrogen transfer agent but not a net hydrogen donor. However, hydrogenated CSO and 9,10-dihydrophenanthrene, which is known from coal liquifaction work to be an excellent donor, were very effective. Product oil yields as high as 36.8 gallons per ton were achieved.

TABLE VI

| RUNS WITH OTHER ADDED OILS | | | | | | |
|---|---|---|---|---|---|---|
| RUN | 23.00 | 24.00 | 25.00 | 26.00 | 31.00 | 32.00 |
| REACTOR | S-A | B | S-A | B | S-A | B |
| SHALE | EASTBC | EASTBC | EASTBC | EASTBC | EASTBC | EASTBC |
| MIN | 10.00 | 10.00 | 10.00 | 10.00 | 10.00 | 10.00 |
| INITIAL PRESSURE (atm) | 1.0 | 1.0 | 1.0 | 1.0 | 1.0 | 1.0 |
| °C. | 405.00 | 405.00 | 405.00 | 405.00 | 405.00 | 405.00 |
| RXN SEVER | 4050 | 4050 | 4050 | 4050 | 4050 | 4050 |
| GAS | 0.38 | 0.50 | 0.35 | 0.32 | 0.50 | 1.00 |
| WATER | 0.65 | 0.70 | 0.70 | 0.08 | 0.50 | 0.70 |
| RTVD | 0.20 | 0.29 | 0.11 | 0.21 | 0.21 | 0.22 |
| G LINE | 0.05 | | 0.23 | | 0.08 | |
| HEPTL SOL | 6.51 | 5.49 | 5.36 | 6.40 | 6.65 | 6.02 |
| PYR SOL | 0.39 | 0.80 | 0.73 | 0.25 | 0.13 | 0.26 |
| RESIDUE | 24.82 | 24.96 | 25.42 | 25.14 | 24.43 | 25.13 |
| TOTAL | 33.00 | 32.74 | 32.90 | 32.40 | 32.50 | 33.33 |
| G/T | 36.80 | 31.30 | 31.00 | 34.80 | 36.10 | 31.10 |
| LOSS | | 0.26 | 0.10 | 0.60 | 0.53 | 0.36 |
| H/P | 16.69 | 6.86 | 7.34 | 25.60 | 51.20 | 23.15 |
| KER CONV | 57.80 | 56.00 | 50.10 | 53.70 | 62.80 | 53.80 |
| B/SA | 0.85 | 0.85 | 1.12 | 1.12 | 0.86 | 0.86 |
| OIL | H-CS01 | H-CS01 | H-CS01 | H-CS01 | DHP | DHP |
| RUN | 35.00 | 36.00 | 37.00 | 38.00 | 40.00 | |
| REACTOR | S-A | B | S-A | B | B | |
| SHALE | EASTBC | EASTBC | EASTBC | EASTBC | EASTBC | |
| MIN | 20.00 | 10.00 | 15.00 | 15.00 | 15.00 | |
| INITIAL PRESSURE (atm) | 1.0 | 1.0 | 1.0 | 1.0 | 1.0 | |
| °C. | 425.00 | 405.00 | 425.00 | 425.00 | 425.00 | |
| RXN SEVER | 8500 | 4050 | 6375 | 6375 | 6375 | |
| GAS | 0.51 | 0.17 | 0.12 | 0.89 | | |
| WATER | 0.40 | 0.60 | 0.42 | 0.15 | | |
| RTVD | | 0.21 | | 0.39 | | |
| G LINE | 0.55 | | 0.08 | | | |
| HEPTL SOL | 13.02 | 4.75 | 11.95 | 11.06 | 13.64 | |
| PYR SOL | 0.19 | 0.41 | 0.16 | 0.16 | 0.08 | |
| RESIDUE | 24.16 | 26.54 | 26.12 | 26.42 | 24.21 | |
| TOTAL | 38.83 | 32.68 | 38.85 | 39.07 | 37.93 | |

TABLE VI-continued

| RUNS WITH OTHER ADDED OILS | | | | | |
|---|---|---|---|---|---|
| G/T | 35.60 | 21.50 | 19.00 | 13.90 | 32.60 |
| LOSS | 1.17 | 0.32 | 1.15 | 0.97 | 2.14 |
| H/P | 31.70 | 11.60 | 30.90 | 25.40 | 45.50 |
| KER CONV | 66.30 | 35.60 | 41.00 | 37.20 | 65.70 |
| B/SA | | | | | |
| OIL | DHP | HFRP | PYRENE | P850 | H-CS01 |

It is important to note that this large yield enhancement can be obtained under very mild conditions. Comparison of runs 31 and 35 in Table VI shows that increasing the time from 10 to 20 minutes, the temperature from 405° C. to 425° C., and the amount of added donor from 3 grams to 10 grams were all unnecessary.

Table VII shows the results of an experiment that gave almost complete conversion of a Green River shale (Western shale) and an oil yield of 118 percent of Fischer Assay at 425° C. for 15 minutes, an oil:shale weight ratio of only 0.33:1 and autogenous pressure. If the Eastern shale results discussed above apply to Western shales, then even this severity was unnecessary.

TABLE VII

| RUN WITH WESTERN SHALE | |
|---|---|
| RUN | 39.00 |
| REACTOR | S-A |
| SHALE | WESTGR |
| MIN | 15.00 |
| INITIAL PRESSURE (atm) | 1.0 |
| °C. | 425.00 |
| RXN SEVER | 6375 |
| GAS | 0.47 |
| WATER | 0.40 |
| HEPT SOL | 13.81 |
| RESIDUE | 25.37 |
| TOTAL | 40.05 |
| G/T | 33.40 |
| LOSS | 0.02 |
| KLR CONV | 83.60 |
| OIL | H-CSO1 |

At very low severity there was essentially no heptane soluble product oil and a slight loss of heptane soluble added oil. With increasing severity, heptane soluble product oil increased, especially in the pressence of added donors. At high severity, heptane solubles decreased and again became negative in the presence of an added oil (Paraho 450°-840° F.) that is not an excellent hydrogen donor. It can be seen that the yield of heptane soluble product increased monotonically with kerogen conversion, except for the regressive reactions at the highest temperature.

The pyridine soluble/heptane-insoluble product fraction oil decreased with increasingly severity. Under mild conditions, the product was substantially polar, functionalized material. Under severe conditions, regressive reactions of product or added heptane solubles did not form heptane insoluble oil but formed mostly gas and some pyridine-insoluble residue.

Gas yields increased with increasing severity. It should be noted that product oil yield passed through a maximum at intermediate severity. The oil vs. gas selectivity was constant at about 9 weight percent oil yield per weight percent gas yield for any length of run at less than 425° C. For runs at 500° C., gas yields increased and oil yields decreased with time.

Mass spectrography analysis of the gases produced in the side-arm reactor showed them to be mostly hydrocarbons, generally about 2 to 3 times as much $C_2$-$C_5$ as methane. There were only traces of hydrogen gas observed, even in runs with 9,10-dihydrophenanthrene, which gas chromotography showed was always completely converted to phenanthrene. There were usually traces of carbon monoxide and a little carbon dioxide.

Hydrogen sulfide yields were typically less than 0.5 weight percent of the shale. This substantially less than the approximately 1 percent hydrogen sulfide produced from this shale in Fischer Assay or Rapid Heat-Up Assays. There were two exceptions: in run 4 (500° C., 10 minutes, 1 atm initial pressure, added 450°-850° F. Paraho) the hydrogen sulfide yield was 2.7 weight percent of the shale. It should be noted that the hydrogen sulfide yield was negligable in run 2 under the same conditions but without added oil and with a product oil yield of only 6.8 gallons per ton. In run 31 (405° C., 1 atm initial pressure, 10 minutes, added 9,10-dihydrophenanthrene) the hydrogen sulfide yield was 0.86 percent based on shale. These results are consistent with the assumption that hydrogen sulfide is formed from the reaction of hydrocarbon with pyrite which reaction is favored by high temperature and the availability of easily donated hydrogen in the hydrocarbon. Maximal oil yields could be achieved at sufficiently low temperatures and sufficiently low hydrogen availability from the donor, that hydrogen sulfide formation could be kept minimal. In comparing the results from the experiments discussed above, it can be seen that in the absence of added normally liquid hydrocardon, heptane-soluble product passed through a maximum with increasing severity, pyridine-soluble/heptane-insoluble product was formed very early and then decreased, and unconverted kerogen plus solid products of regressive reactions decreased steadily. This latter point indicates that under the most severe conditions used in this work, the rate of formation of new products exceeded the rate of coking. However, gas formation was so large that oil yields decreased.

Added Paraho oil changes this picture. The trends for gas, total heptane-soluble oil recovered, and total heptane-insoluble/pyridine soluble material recovered were similar to those in the absence of added oil. However, in this case, at high severities the rate of formation of pyridine-insoluble residue exceeded the rate of formation of new products from the kerogen, so the apparent conversion decreased. There are two possible contributing factors. First, the conversion was higher at low severities so the amount and ease of further kerogen conversion might be expected to be less. Second, the added Paraho oil may be more susceptible to regressive reactions than is product oil from the shale. By initiating and/or propagating free radical reactions, the added oil may even promote regression of the product oil.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. In a hydrogen transfer extraction process for recovering hydrocarbonaceous fluids from oil shale containing kerogen where a mixture of said oil shale and a normally liquid hydrocarbon is reacted under substantially autogeneous pressure and a temperature under the retorting temperature of said oil shale for a period of time sufficient to recover hydrocarbonaceous fluids from said shale wherein the amount of liquid hydrocarbon in the mixture does not exceed 25 percent by weight of the shale, the improvement comprising:

(a) cooling the reactants and recovering by distillation said hydrocarbonaceous fluids from said shale;

(b) extracting the reacted shale with a solvent selected from a member of the group consisting of heptane, pyridine, tetrahydrofuran and mixtures thereof, which extract contains substantially increased amounts of hydrocarbonaceous fluids, which fluids contain substantially reduced amounts of hydrocarbonaceous gases and substantially increased amounts of hydrocarbonaceous liquids; and (c) stripping said solvent from said extract and recovering said extract.

2. The process of claim 1 wherein the temperature is from about 300° C. to about 450° C., the initial pressure is greater than or equal to 1 atmosphere, and the period of time is at least 0.5 minutes.

3. The process of claim 1 wherein the temperature is from about 350° C. to about 425° C. and the duration time is from about 0.5 minutes to about 30 minutes.

4. The process of claim 1 wherein the ratio of the oil shale to the normally liquid hydrocarbon is from about 4:1 to about 100:1 by weight.

5. The process of claim 1 wherein the normally liquid hydrocarbon in the mixture is a hydrogen-donor.

6. The process of claim 1 wherein the normally liquid hydrocarbon in the mixture is selected from the group consisting of petroleum or fractions thereof, shale oil or fractions thereof, or any mixture thereof.

7. The process of claim 6 wherein the normally liquid hydrocarbon comprises fractions having a distillation temperature of not less than 625° F.

8. The process of claim 1 wherein hydrogen sulfide formation is substantially less than hydrogen sulfide formation under retorting conditions.

9. In a hydrogen transfer reaction process for recovering hydrocarbonaceous fluids from oil shale where a mixture of oil shale and a normally liquid hydrocarbon is reacted under initial substantially atmospheric pressure and a temperature below the retorting temperature of the shale for a period of time sufficient to recover hydrocarbonaceous fluids from the oil shale wherein the normally liquid hydrocarbon does not comprise greater than 25% of hydrogen donating compounds, the improvement comprising:

(a) cooling the reactants and recovering by distillation said hydrocarbonaceous fluids from said shale;

(b) extracting the reacted shale with a solvent selected from a member of the group consisting of heptane, pyridine, tetrahydrofuran and mixtures thereof, which results in a substantial increase in the recovery of hydrocarbonaceous fluids in a resultant extract; and (c) thereafter stripping said solvent from said extract and recovering the hydrocarbonaceous fluids, which fluids contain substantially reduced amounts of hydrocarbonaceous gases and substantially increased amounts of hydrocarbonaceous liquids.

10. The process of claim 9 wherein the temperature is from about 300° C. to about 450° C., the initial pressure is greater than or equal to 1 atmosphere, and the period of time is at least 0.5 minutes.

11. The process of claim 9 wherein the temperature is from about 350° C. to about 425° C. and the duration time is from about 0.5 minutes to about 30 minutes.

12. The process of claim 9 wherein the ratio of the oil shale to the normally liquid hydrocarbon is from about 1:1 to about 1:0.01 by weight.

13. The process of claim 9 wherein the ratio of the oil shale to the normally liquid hydrocarbon is from about 1:0.2 to about 1:0.05 by weight.

14. The process of claim 9 wherein the normally liquid hydrocarbon in the mixture is selected from the group consisting of petroleum or fractions thereof, shale oil or fractions thereof, or any mixture thereof.

15. The process of claim 9 wherein hydrogen sulfide formation is substantially less than hydrogen sulfide formation under retorting conditions.

16. The process of claim 9 wherein the resulting hydrocarbon fluids are recovered in amounts greater than 100 percent Fischer Assay.

17. In a hydrogen transfer reaction process for improving the recovery of oil from oil shale comprising the steps of bringing a mixture of oil shale and a hydrocarbon fluid to a temperature below the retorting temperature of said shale wherein the hydrocarbon fluid has a distillation temperature of not less than 625° F.; reacting the mixture at a temperature in the range of about 300° C. to about 450° C. in the absence of added pressure for a period of time of at least 0.5 minutes to about 10 minutes for a period of time sufficient to recover hydrocarbonaceous fluids from said oil shale wherein said liquid hydrocarbon to oil shale ratio is about 1:10 by weight, the improvement comprising:

(a) cooling the reactants and recovering by distillation said hydrocarbonaceous fluids from said shale;

(b) extracting the reacted shale with a solvent selected from a member of the group consisting of heptane, pyridine, tetrahydrofuran and mixtures thereof; and (c) stripping said solvent from a resultant extract and recovering said hydrocarbonaceous fluids, which fluids contain substantially reduced amounts of hydrocarbonaceous gases and substantially increased amounts of hydrocarbonaceous liquids greater than 100 percent Fischer assay when combined with said hydrocarbonaceous fluids of step (a) and which combined fluids contain substantially reduced amounts of hydrogen sulfide.

18. The process of claim 17 wherein the hydrocarbon fluid consists essentially of shale oil or fractions thereof, petroleum or fractions thereof, or any mixtures thereof.

19. The process of claim 17 wherein the hydrocarbon fluid is a hydrogen donor.

20. The process as recited in claim 1 where in step (b) said solvent comprises heptane which is extracted with said shale overnight.

21. The process as recited in claim 1 where in step (a) said hydrocarbonaceous fluids are recovered by vacuum distillation at an atmospheric boiling point up to about 400° F.

* * * * *